US008432249B2

(12) United States Patent
Bailey-VanKuren et al.

(10) Patent No.: US 8,432,249 B2
(45) Date of Patent: Apr. 30, 2013

(54) ADVANCED TRANSITIONAL CUP

(75) Inventors: Michael Bailey-VanKuren, Hamilton, OH (US); Donna R. Scarborough, Cincinnati, OH (US)

(73) Assignee: Miami University, Oxford, OH (US)

( * ) Notice: Subject to any disclaimer, the term of this patent is extended or adjusted under 35 U.S.C. 154(b) by 599 days.

(21) Appl. No.: 12/753,147

(22) Filed: Apr. 2, 2010

(65) Prior Publication Data

US 2010/0252563 A1 Oct. 7, 2010

Related U.S. Application Data

(60) Provisional application No. 61/165,971, filed on Apr. 2, 2009.

(51) Int. Cl.

| | |
|---|---|
| ***G05B 23/02*** | (2006.01) |
| *A61J 7/23* | (2006.01) |
| *A61M 1/00* | (2006.01) |
| *A47G 19/22* | (2006.01) |
| *B65D 51/18* | (2006.01) |

(52) U.S. Cl.
USPC ..... 340/3.71; 604/77; 604/30; 220/713; 220/714; 220/254.9

(58) Field of Classification Search ..... 340/573.1; 604/30–33, 77
See application file for complete search history.

(56) References Cited

U.S. PATENT DOCUMENTS

| | | | | |
|---|---|---|---|---|
| 3,790,016 | A * | 2/1974 | Kron | 215/11.1 |
| 5,048,705 | A * | 9/1991 | Lynd et al. | 215/388 |
| 5,079,013 | A * | 1/1992 | Belanger | 426/115 |
| D450,535 | S * | 11/2001 | McDonough et al. | D7/510 |
| D452,415 | S * | 12/2001 | McDonough et al. | D7/510 |
| 6,422,415 | B1 * | 7/2002 | Manganiello | 220/714 |
| 6,568,557 | B2 * | 5/2003 | Fusco et al. | 220/714 |
| 6,588,593 | B2 * | 7/2003 | Woskoski | 206/459.1 |
| 6,786,352 | B2 * | 9/2004 | Belcastro | 220/714 |
| 7,204,380 | B2 * | 4/2007 | Webb et al. | 215/11.4 |
| 2005/0029265 | A1 * | 2/2005 | Morgan et al. | 220/254.9 |
| 2005/0269336 | A1 * | 12/2005 | Rockhill et al. | 220/705 |

* cited by examiner

*Primary Examiner* — Albert Wong
*Assistant Examiner* — Royit Yu
(74) *Attorney, Agent, or Firm* — Jason H. Foster; Kremblas & Foster

(57) ABSTRACT

An advanced transitional cup (ATC) for training developing children and developmentally-challenged individuals to drink from a cup. The ATC includes a lid with a small fluid aperture and an electric air valve. A microcontroller located in the base of the ATC converts a user-defined "flow rate" into a PWM voltage signal that successively opens and closes the air valve. A higher flow rate results in a PWM signal that opens the air valve for longer spans of time and closes the air valve for shorter spans of time as compared to a lower flow rate, thereby allowing more air to enter the ATC and fluid to be expressed from the fluid aperture more readily. A touch sensor on the sidewall of the ATC prevents the air valve from being opened, and thus fluid from exiting the fluid aperture, unless a drinker is touching the touch sensor, thereby preventing accidental spills.

20 Claims, 2 Drawing Sheets

ADVANCED TRANSITIONAL CUP

CROSS-REFERENCES TO RELATED APPLICATIONS

This application claims the benefit of U.S. Provisional Application No. 61/165,971 filed Apr. 2, 2009, which is incorporated herein by reference.

STATEMENT REGARDING FEDERALLY-SPONSORED RESEARCH AND DEVELOPMENT (Not Applicable)

REFERENCE TO AN APPENDIX (Not Applicable)

BACKGROUND OF THE INVENTION

In the United States the population of live births is approximately 4 million infants per year. Each of these infants goes through significant developmental changes during the first two years of life in order to transition from nipple feedings from a breast or a bottle to drinking from a cup. However, efficient cup drinking is a complex process that requires a child to coordinate head, trunk, hand to mouth, lip, tongue, and jaw movements, manage a variety of fluid viscosities, and coordinate swallowing and breathing patterns to variable volume and flow rates. Given the complexity of managing these various factors, developing children might be introduced to cup drinking around 6 months of age, but frequently require as much as 18 months of practice to become independent with efficient cup drinking.

For children with developmental disabilities who might be further delayed in obtaining all of the precursors related to cup drinking, the ability to transition to an open cup can take even longer. In addition, children with either high (i.e. cerebral palsy, prematurity) or low (Down syndrome) muscle tone or major structural anomalies (i.e. cardiac, cleft palate) may also face additional challenges of transitioning to an open cup because of an inability to control the bolus, therefore putting them at great risk for aspiration.

During a child's lengthy developmental process (whether the child be developmentally disabled or not), the child typically either remains on a bottle or is transitioned to a "training-cup" that is frequently equipped with a "no-spill" lid that requires the child to suck on a spout in order to break a pressure vacuum seal and to continue sucking to acquire a stream of fluid through the spout. Companies that design these training cups frequently direct marketing strategies to highlight that children in this developmental transition period are prone to spill when using an open cup, thereby creating an inconvenience for caregivers. The effectiveness of these marketing strategies has resulted in the proliferation of "no-spill" cups despite warnings from American Dental Association (ADA) against the use of such cups. The ADA released a statement in 2004 that described "no-spill" training cups as "nothing more than baby bottle(s) in disguise," recommending that parents avoid this type of training cup because of the well documented, long-term complications of extended bottle use. These complications include: otitis media, iron deficiencies, obesity, and dental caries. Furthermore, because the design characteristics of almost all current "no-spill" cups requires active strong sucking by a drinker, other complications such as dental occlusion patterns, temporomandibular joint dysfunction, and myofunctional disorders are also a concern.

In view of the foregoing, it would be advantageous to provide a drinking cup with a no-spill feature for developing children and developmentally-challenged individuals that does not require the drinker to create intra-oral pressure (i.e. to suck) in order to acquire a stream of fluid.

BRIEF SUMMARY OF THE INVENTION

In accordance with the purposes of the present invention, there is provided an advanced transitional cup (ATC) for promoting the healthy transition of drinking patterns from bottles to cups. The ATC includes a fluid vessel and a removable lid with a small fluid aperture through which fluid can be expressed from the ATC during drinking. The fluid vessel and the lid define a main fluid chamber in which the drinking fluid is stored. An electric air valve is located within the lid for controlling air flow into the main fluid chamber. When the valve is closed, air is prevented from entering the main fluid chamber, and atmospheric pressure prevents the drinking fluid from exiting the fluid aperture. When the air valve is open, air is allowed to enter the main fluid chamber, thereby equalizing the air pressure within the chamber and allowing fluid to pour out of the fluid aperture.

A battery powered microcontroller, preferably located in a removable base of the ATC, is electrically connected to the air valve. The microcontroller sends a pulse width modulated (PWM) voltage signal to the air valve that causes the air valve to successively open and close. The characteristics of the PWM signal are defined by a "flow rate" value that is stored by the microcontroller. A higher flow rate value corresponds to a PWM signal that keeps the air valve open for a greater duration and closed for a shorter duration. A lower flow rate value corresponds to a PWM signal that keeps the air valve open for a shorter duration and closed for a longer duration. A higher flow rate thus results in a greater amount of air entering the main fluid chamber of the ATC, which in turn results in drinking fluid being expressed more readily from the fluid aperture.

A user input control is located on the base of the ATC and preferably includes an "up" button and a "down" button that are electrically connected to the microcontroller.

The user input control allows a user to incrementally increase or decrease the flow rate that is stored by the microcontroller. This allows a user to precisely control the rate at which fluid can be expressed from the ATC to better accommodate a particular individual's ability to drink from a cup without spilling or aspirating. Specifically, if a particular individual exhibits a lack of ability to drink in such a manner, the flow rate of the ATC can be set very low to make drinking easier. Conversely, if an individual has developed a greater ability to manage a larger stream of drinking fluid, the flow rate can be set higher. The flow rate is preferably displayed as an integer value between 1 and 10 on a digital display that is built into the base.

A "no-spill" feature of the ATC is embodied by a touch sensor that surrounds the fluid vessel at a location that is likely to be gripped by a person drinking from the ATC. The touch sensor is preferably formed of a band of thin film polymer resistive material. If an individual manually engages the touch sensor, the sensor outputs a voltage signal to the microcontroller that enables transmission of the PWM signal (described above) to the air valve, thus allowing fluid to be poured from the fluid aperture. If, however, the touch sensor is not engaged, the microcontroller will not send the PWM signal to the air valve and the air valve will remain shut, thus substantially preventing fluid from being expressed from the fluid aperture. Therefore, if the ATC is accidentally knocked over the air valve will remain closed and little or no drinking fluid will be spilled.

The ATC is intended for everyday use by developing children that are transitioning between drinking from a bottle to an open cup, as well as by children with developmental delays.

Figure 1:
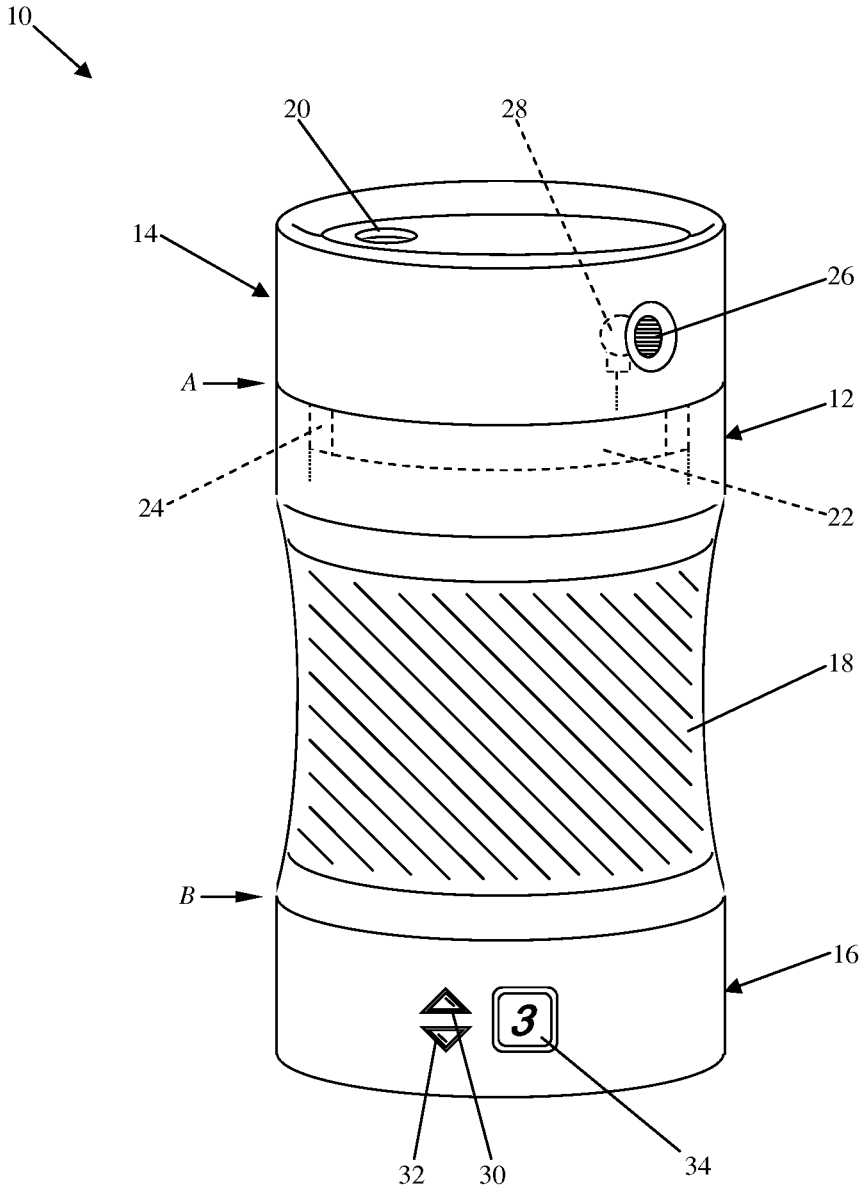
FIG. 1 is a front perspective view illustrating the preferred embodiment of the present invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

Referring to FIG. 1, an advanced transitional cup (ATC) 10 for training developing children and developmentally-challenged individuals to drink from a cup is shown. The ATC 10 generally includes a fluid vessel 12, a lid 14, and a base 16. Unless otherwise noted, all components of the ATC 10 are fabricated from a plastic such as High Density Polyethylene (HDPE), Low Density Polyethylene (LDPE), Polyethylene Terephthalate (PET), Polyvinyl Chloride (PVC), Polypropylene (PP), or Polystyrene (PS). Although plastic is preferred, it is contemplated that any other sufficiently rigid, food-grade and watertight materials, such as aluminum and stainless steel, can additionally or alternatively be used to fabricate the ATC 10.

For the sake of convenience and clarity, terms such as "top," "bottom," "up," "down," "inward," "outward," "vertical" and "horizontal" will be used herein to describe the relative placement and orientation of the various components of the ATC 10, all with respect to the geometry and orientation of the ATC 10 as it appears in FIG. 1. Said terminology will include the words specifically mentioned, derivatives thereof, and words of similar import.

The fluid vessel 12 of the ATC 10 is a generally cylindrical body having an internal fluid chamber (not within view) with a preferred volume of about 6-8 ounces (180-240 mL). It is contemplated that the fluid chamber can have a smaller or larger volume. The fluid vessel 12 has an open top end at the juncture A of the fluid vessel 12 and the lid 14 and a closed bottom end B at the juncture of the fluid vessel 12 and the base 16. The fluid vessel 12 is provided with a partially concave sidewall and a largest outer diameter of about 3 inches for allowing a child user to comfortably and easily grip and hold the ATC 10, as well as for other reasons that will be described below. Although this partially concave, cylindrical shape is generally preferred for the fluid vessel 12, it is contemplated that the fluid vessel 12 can have a variety of other shapes. For example, the sidewall of the fluid vessel 12 can alternatively be entirely concave (with no straight portions) or can be partially or entirely convex or entirely straight. Furthermore, instead of being cylindrical with a circular cross section, it is contemplated that the fluid vessel 12 can have virtually any other cross sectional shape, including, but not limited to rectangular, oval, triangular, or even an irregular shape.

A touch sensor 18 covers the outer surface of the concave portion of the fluid vessel's sidewall that is intermediate along the ATC's height. The touch sensor is formed of a band of thin film polymer resistive material that is capable of outputting an electrical signal on an electrical output line (not within view) when the band is touched. It is contemplated that the touch sensor 18 can alternatively be formed of other types of touch sensitive materials or well-know touch sensitive devices. It is further contemplated that a manually-depressible button or other manually activated input device can be substituted for the touch sensor 18. The function of the touch sensor 18 as it relates to the operation of the ATC 10 will be described in further detail below.

The lid 14 of the ATC 10 is a substantially cylindrical body having an open bottom end at the juncture A of the lid 14 and the fluid vessel 12 and a substantially closed top end with a small fluid aperture 20 formed therethrough. The lid 14 has an internal fluid chamber (not within view) that is in fluid communication with the internal fluid chamber of the fluid vessel 12, thus creating a single, contiguous, main fluid chamber defined by the lid 14 and the fluid vessel 12. The lid 14 is provided with an annular lip 22 that extends downwardly from the bottom edge of the lid 14 and into the open top end of the fluid vessel 12. A rubber O-ring 24 surrounds the outside of the lip 22 and snugly engages the interior surface of the fluid vessel 12's sidewall. This is a conventional configuration that maintains a firm, fluid-tight seal between the lid 14 and the fluid vessel 12 when the ATC 10 is in use, while allowing the lid 14 to be removed from the fluid vessel 12 (such as for filling or emptying the fluid vessel 12) in a convenient manner by manually pulling the lid 14 away from the fluid vessel 12 with a moderate amount of force. Although this configuration is preferred, it is contemplated that alternative structural features can be incorporated for maintaining a fluid-tight seal between the lid 14 and the fluid vessel 12 and facilitating convenient removal of the lid 14. For example, the lid 14 can be threaded to engage the fluid vessel 12 in a manner that will be recognized by those of skill in the art.

An air vent 26 is formed in the sidewall of the lid 14 and a small, electric air valve 28 (shown in phantom) is mounted to the inside of the sidewall, directly behind the air vent 26. The air valve 28 is electrically connected to a microcontroller, and can be closed and opened in response to an electrical input signal as will be described in greater detail below. When the air valve 28 is open, air is allowed to flow through the air vent 26 into the main fluid chamber. When the air valve 28 is closed, air is prevented from flowing through air vent 26. Thus, if a user attempts to pour fluid out of the ATC 10 through the fluid aperture 20 when the air valve 28 is closed, the atmospheric pressure outside of the ATC 10 builds rapidly to exceed the fluid pressure inside the main fluid chamber. Thus, the fluid is substantially prevented from exiting the fluid aperture 20. Conversely, if a user attempts to pour fluid out of the ATC 10 through the fluid aperture 20 when the air valve 28 is open, air is allowed to enter the main fluid chamber through the air vent 26, thus equalizing the air pressure inside and outside of the ATC 10 and allowing the fluid to flow out of the fluid aperture 20. In order for this configuration to function properly, the fluid aperture 20 must be sufficiently small to prevent air from entering the fluid aperture 20 while fluid simultaneously exits the fluid aperture 20 when the air valve 28 is closed. Although it is preferred for the air vent 26 and the air valve 28 to be located in the lid 14 of the ATC 10, it is contemplated that an air vent 26 and an air valve 28 can alternatively be located in the sidewall of the fluid vessel 12.

The base 16 of the ATC 10 is a substantially cylindrical body having a closed bottom end and an open top end at the juncture B of the base 16 and the fluid vessel 12. The base 16 has a fluid-tight internal cavity (not within view) that houses most of the electrical and electronic components of the ATC 10. These components include an electronic microcontroller (not within view), a battery (not within view) which is preferably a conventional watch-type battery, a user input control consisting of an "up" button 30 and a "down" button 32, and a flow rate display 34 consisting of a conventional liquid crystal display (LCD).

A threaded annular lip (not within view) extends upwardly from the top edge of the base 16 and engages a threaded annular recess (not within view) in the bottom of the fluid vessel 12. The base 16 can thus be unscrewed from the fluid vessel 12 for conveniently accessing the battery and other components that reside within the base's internal cavity. It is contemplated that the base 16 can be removably secured to the fluid vessel 12 by a variety of alternative means, such as by snap fit or with removable fasteners. It is further contemplated that base 16 can be a non-removable, integral extension of the fluid vessel 12, in which case a removable panel or door can be located on the bottom or side of the base 16 for accessing the battery and/or other components.

Each of the battery, the user input control, the flow rate display, the touch sensor 18 (described above) and the electric air valve 28 (described above) are electrically connected to the microcontroller in a manner that will now be described in the context of the operation of the ATC 10.

During typical operation of the ATC 10, a user (generally a parent or a caregiver of the person who is to drink from the cup) first manipulates the user input control to incrementally increase or decrease a desired "flow rate" that is stored by the microcontroller. A "flow rate" is a rate at which fluid will be expressed from the fluid aperture 20 of the ATC 10. The microcontroller stores the flow rate in internal memory and displays the flow rate on the flow rate display (which is powered by the battery) as an integer between 1-10. It is contemplated that a greater or fewer number of flow rate gradations can be implemented. For example, if the current flow rate is set to 3 and the user wishes to increase the flow rate to 5, the user presses the "up" button twice, thereby instructing the microcontroller to increase the stored flow rate from 3 to 5. However, if the current flow rate is set to its maximum level of 10 and the user presses the "up" button, the flow rate remains at 10. Similarly, if the current flow rate is set to its minimum level of 1 and the user presses the "down" button, the flow rate remains at 1.

It is contemplated that various other input devices can be substituted for the "up" and "down" buttons of the user input control. For example, a rotatable dial or a sliding lever can be operatively connected to the microcontroller for controlling the flow rate. Similarly, it is contemplated that a variety of the other display means can be substituted for the LCD of the flow rate display. For example, conventional light emitting diodes (LEDs) can be used to display numerals corresponding to the flow rate. Alternatively, numerals can be omitted altogether and the flow rate can be represented by a different visual indicator such as a series of vertical bars of increasing height, wherein a number of the bars corresponding to the flow rate is illuminated. The flow rate can additionally or alternatively be audible, such as by ascending chimes or other tones.

After the desired flow rate has been set, the ATC 10 is handed to, or is picked up by, the person (the "drinker") who is to drink from the ATC 10. Generally, the drinker will naturally grip the touch sensor 18 on the concave portion of the fluid vessel 12's sidewall. Upon being touched by the drinker, the touch sensor 18 outputs an electrical signal to the microcontroller that switches the microcontroller from an "off" state to an "on" state (described below). The microcontroller will remain in the "on" state as long as the touch sensor 18 is being touched, and will switch back to the "off" state if the touch sensor 18 is not being touched.

When the microcontroller is in the "on" state (i.e., when the touch sensor 18 is being touched) the microcontroller outputs a pulse width modulated (PWM) voltage signal to the electric air valve 28 that corresponds to the stored flow rate that was previously set by the user. The PWM signal is a waveform that causes the air valve 28 to successively open and close with rapid frequency. In particular, a higher flow rate setting results in a PWM signal that keeps the electric air valve 28 open for longer spans of time and closed for shorter spans of time than a lower flow rate setting. The microcontroller thus translates the flow rate setting into a percentage of "open time" for the air valve 28. For example, a flow rate setting of 3 results in a PWM signal that alternates between keeping the air valve 28 open for 0.1 seconds and keeping the air valve 28 closed for 0.3 seconds. Conversely, a flow rate setting of 7 results in a PWM signal that alternates between keeping the air valve 28 open for 0.3 seconds and closed for 0.1 seconds. It is to be understood that the duration and proportion of open and closed times can be varied without departing from the present invention.

As described above, air is allowed to enter the main fluid chamber of the ATC 10 when the air valve 28 is open, which allows fluid to be expressed from the fluid aperture 20. Thus, when the air valve 28 is open for a greater percentage of time and is closed for a lesser percentage of time more air is allowed to enter the main fluid chamber and fluid can be expressed from the fluid aperture 20 more readily than when the air valve 28 is open for a lesser percentage of time and closed for a greater percentage of time. A user can thereby easily control the rate at which fluid is expressed from the fluid aperture 20 by manipulating the "up" and "down" buttons to increase or decrease the flow rate setting. This "smart" flow control mitigates the risk and severity of a drinker's spills while obviating the need for the drinker to create intra-oral pressure to initiate and/or maintain fluid flow as is required by traditional "no-spill" cups. A drinker is merely required to tilt the ATC 10 in the manner of a normal cup to establish and maintain fluid flow. The flow rate setting will generally be varied in accordance with factors such as the drinker's ability to drink from the ATC 10 without spilling (the greater the drinker's ability, the higher the flow rate can be set) and the viscosity of the fluid contained in the main fluid chamber (less viscous fluids will naturally flow more readily than more viscous fluids).

Since the touch sensor 18 of the ATC 10 is located in the concave portion of the fluid vessel 12's sidewall, the touch sensor 18 is generally prevented from coming into contact with another surface if the ATC 10 falls onto its side. Thus, even if the ATC 10 is inadvertently knocked over, such as if it were to be accidently dropped or tipped, the touch sensor 18 will not be engaged and the microcontroller will remain in the "off" state. The air valve 28 will therefore be kept closed and fluid will be substantially prevented from spilling out of the fluid aperture 20. This anti-spill feature allows parents and caregivers to confidently and effectively employ the ATC 10 without worrying about the inconvenience of spills. Embodiments of the ATC 10 are contemplated in which the touch sensor 18 is omitted, although the inclusion of the touch sensor 18 or an alternative manual input device is highly preferred for confirming a drinker's intent to drink from the ATC 10 before allowing fluid to be expressed from the fluid aperture 20.

Figure 2:
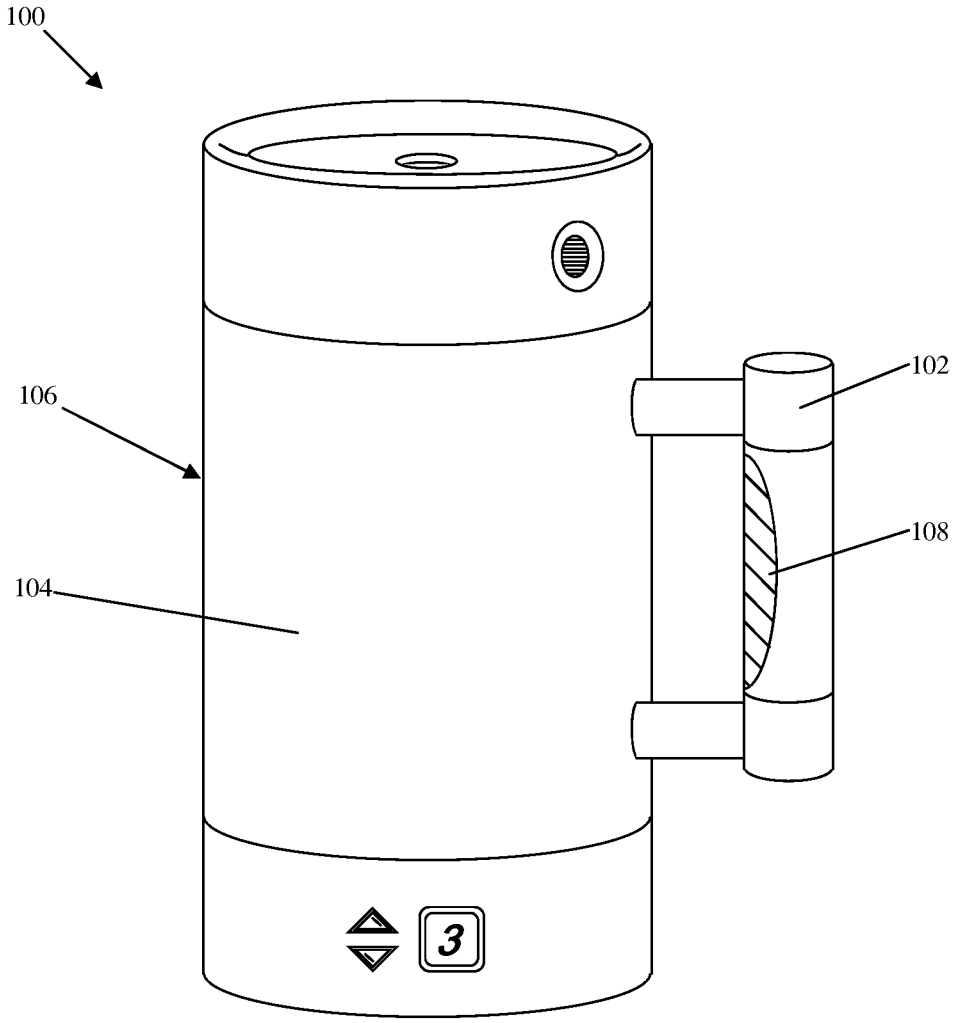
FIG. 2 is a front perspective view illustrating an alternative embodiment of the advanced transitional cup.

Referring to FIG. 2, an alternative embodiment 100 of the ATC is contemplated wherein a handle 102 is mounted to the sidewall 104 of the fluid vessel 106 for engagement by a drinker. In such an embodiment, a touch sensor 108 is preferably located on the handle 102 and is electrically connected to the ATC's microcontroller in the manner described above for actuating the ATC's air valve (not within view) when a drinker grips the handle 102. The touch sensor 108 is preferably only located on an inwardly facing area of the handle 102 to prevent the touch sensor 108 from inadvertently being engaged if the ATC 100 is knocked over.

This detailed description in connection with the drawing is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A transitional drinking cup comprising:

a. a fluid vessel having an open top;

b. a removable lid mounted over the open top of the fluid vessel to define a fluid chamber within the lid and the fluid vessel, the lid having a fluid aperture for allowing fluid to exit the fluid chamber;

c. an air valve for controllably allowing air to pass into the fluid chamber through an air vent;

d. a microcontroller electrically connected to the air valve for opening and closing the air valve for predetermined lengths of time that correspond to an electronically stored flow rate value;

e. a battery electrically connected to the microcontroller; and f. a user input control electrically connected to the microcontroller for allowing a user to adjust the flow rate value.

2. The transitional drinking cup in accordance with claim 1, further comprising a manually-actuable input device mounted to an exterior of the cup that is electrically connected to the microcontroller, wherein the microcontroller only opens the air valve if the input device is actuated.

3. The transitional cup in accordance with claim 2, wherein the input device is a touch sensor.

4. The transitional cup in accordance with claim 3, wherein the touch sensor is formed of a band of thin film polymer resistive material that at least partially surrounds a sidewall of the cup.

5. The transitional cup in accordance with claim 3, wherein a sidewall of the cup is at least partially concave and the touch sensor is mounted at the concave region.

6. The transitional cup in accordance with claim 2, wherein the input device is a button.

7. The transitional drinking cup in accordance with claim 1, further comprising a handle mounted to the cup.

8. The transitional drinking cup in accordance with claim 7, further comprising a manually-actuable input device mounted to the handle that is electrically connected to the microcontroller, wherein the microcontroller only opens the air valve if the input device is actuated.

9. The transitional cup in accordance with claim 8, wherein the input device is a touch sensor.

10. The transitional cup in accordance with claim 9, wherein the touch sensor is formed of a band of thin film polymer resistive material that at least partially surrounds the handle.

11. The transitional cup in accordance with claim 8, wherein the input device is a button.

12. The transitional cup in accordance with claim 1, further comprising a digital display electrically connected to the microcontroller for displaying the flow rate value.

13. The transitional cup in accordance with claim 1, wherein the user input control comprises an "up" button and a "down" button, wherein pressing the "up" button incrementally increases the flow rate value and pressing the "down" button incrementally decreases the flow rate value.

14. The transitional cup in accordance with claim 1, further comprising a base mounted to a bottom of the fluid vessel, the base having a fluid tight internal cavity in which the microcontroller and the battery are housed.

15. A transitional cup for training individuals to drink from a cup comprising:

a. a fluid vessel having an open top;

b. a removable lid mounted over the open top of the fluid vessel to define a fluid chamber within the lid and the fluid vessel, the lid having a fluid aperture for allowing fluid to exit the fluid chamber;

c. an air valve for controllably allowing air to pass into the fluid chamber through an air vent;

d. a microcontroller electrically connected to the air valve for opening and closing the air valve for predetermined lengths of time that correspond to an electronically stored flow rate value;

e. a battery electrically connected to the microcontroller;

f. a user input control electrically connected to the microcontroller for allowing a user to adjust the flow rate value;

g. a touch sensor electrically connected to the microcontroller, wherein the microcontroller will not open the air valve unless touch sensor is being touched; and h. a digital display electrically connected to the microcontroller for displaying the flow rate value.

16. The transitional cup in accordance with claim 15, wherein the user input control comprises an "up" button and a "down" button, wherein pressing the "up" button incrementally increases the flow rate value and pressing the "down" button incrementally decreases the flow rate value.

17. The transitional cup in accordance with claim 15, wherein a sidewall of the cup is at least partially concave and the touch sensor is mounted at the concave region.

18. The transitional drinking cup in accordance with claim 15, further comprising a handle mounted to the cup.

19. The transitional drinking cup in accordance with claim 16, wherein the touch sensor is mounted to the handle.

20. The transitional cup in accordance with claim 15, further comprising a base mounted to a bottom of the fluid vessel, the base having a fluid tight internal cavity in which the microcontroller and the battery are housed.

* * * * *